US008573107B1

(12) United States Patent
Yim et al.

(10) Patent No.: US 8,573,107 B1
(45) Date of Patent: Nov. 5, 2013

(54) BURSTER TUBE LOADING APPARATUS AND METHOD

(75) Inventors: Kyung B. Yim, Morris Plains, NJ (US); John A. Wittu, DeSoto, TX (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 216 days.

(21) Appl. No.: 13/196,155

(22) Filed: Aug. 2, 2011

(51) Int. Cl.
*F42B 33/02* (2006.01)
*F42B 33/00* (2006.01)

(52) U.S. Cl.
USPC ..... 86/20.14

(58) Field of Classification Search
USPC ..... 86/20.1, 20.14, 31
See application file for complete search history.

(56) References Cited

U.S. PATENT DOCUMENTS

| | | | | | |
|---|---|---|---|---|---|
| 2,751,810 | A * | 6/1956 | Clark et al. | ..... | 86/20.14 |
| 2,877,709 | A * | 3/1959 | Duckworth | ..... | 102/531 |
| 2,953,093 | A * | 9/1960 | Chase, Jr. et al. | ..... | 102/314 |
| 2,976,757 | A * | 3/1961 | Schulz | ..... | 86/20.14 |
| 3,034,393 | A * | 5/1962 | Lieberman et al. | ..... | 86/1.1 |
| 3,552,259 | A * | 1/1971 | Griffith | ..... | 86/20.1 |
| 3,557,656 | A * | 1/1971 | Precoul | ..... | 86/31 |
| 4,383,468 | A * | 5/1983 | Sie et al. | ..... | 86/1.1 |
| 4,409,155 | A * | 10/1983 | Bonnycastle et al. | ..... | 264/3.1 |
| 5,212,341 | A * | 5/1993 | Osborne et al. | ..... | 102/275.8 |
| 5,354,519 | A * | 10/1994 | Kaeser | ..... | 264/3.1 |
| 2005/0188824 | A1 * | 9/2005 | Pressley | ..... | 86/31 |

* cited by examiner

*Primary Examiner* — Bret Hayes
(74) *Attorney, Agent, or Firm* — Michael C. Sachs

(57) ABSTRACT

An apparatus usable for loading a plurality of burster tubes with an energetic mix which may include a polymeric suspension. A cooling cylinder is positioned upon a base. A distribution fixture situated upon the cooling cylinder is used for simultaneously and continuously loading the burster tubes with the energetic mix. There are also a plurality of receiving fixtures on the base each one for receiving an end of one of the plurality of burster tubes.

15 Claims, 10 Drawing Sheets

BURSTER TUBE LOADING APPARATUS AND METHOD

U.S. GOVERNMENT INTEREST

The inventions described herein may be manufactured, used and licensed by or for the U.S. Government for U.S. Government purposes.

FIELD OF THE DISCLOSURE

This disclosure relates generally to the field of munitions. More particularly, it pertains to an apparatus and method for loading burster tubes such as the M54 A1 Burster tubes.

BACKGROUND OF THE DISCLOSURE

Burster tubes are structures that contain an energetic mix and are placed into projectiles that produce—for example—smoke upon detonation. The proper loading of a burster tube is of critical importance to their successful deployment and use.

SUMMARY OF THE DISCLOSURE

Such an advance in the art is made according to an aspect of the present disclosure directed to structures and methods for loading burster tubes such as may be used—for example—in 155 mm projectiles.

Viewed from a first aspect, the present disclosure is directed to a burster tube loading assembly comprising a cooling chamber, a plurality of receiving fixtures each including a weep hole, and a distribution fixture having a heating/cooling manifold/chamber for preheating the distribution fixture. When a plurality of unloaded burster tubes are positioned within the cooling chamber—each in a respective receiving fixture, the tubes may be continuously and simultaneously loaded with an energetic mixture via the preheated distribution fixture positioned at a top of the chamber. Advantageously, weep holes positioned within the receiving fixture permit any trapped air to escape during loading thereby ensuring a uniform load. Finally, ports disposed along the sides of the cooling chamber permit the selective cooling/solidification of the energetic mixture after loading portions of the burster tubes thereby ensuring a uniform, solid mix.

Viewed from another aspect, the present disclosure is directed to a method for loading burster tubes. According to this aspect, unloaded burster tubes are positioned within a cooling chamber having a plurality of receiving fixtures with weep holes. A distribution fixture is positioned on a top portion of the cooling chamber such that it is in simultaneous fluid communication with the plurality burster tubes. A liquefied energetic mixture—which may be a polymeric suspension—is flowed onto the distribution fixture from which it is delivered simultaneously and continuously to each of the burster tubes. As the tubes fill with the liquefied mix, any air trapped within the tubes is vented via the weep holes. Depending upon the mix and its properties, coolant may be circulated within the cooling chamber such that the energetic mix is selectively cooled and solidified at various levels of the tubes. In this manner, a uniform solid energetic mix is formed within each of the burster tubes.

BRIEF DESCRIPTION OF THE DRAWING

A more complete understanding of the present disclosure may be realized by reference to the accompanying drawings in which.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

Figure 1:
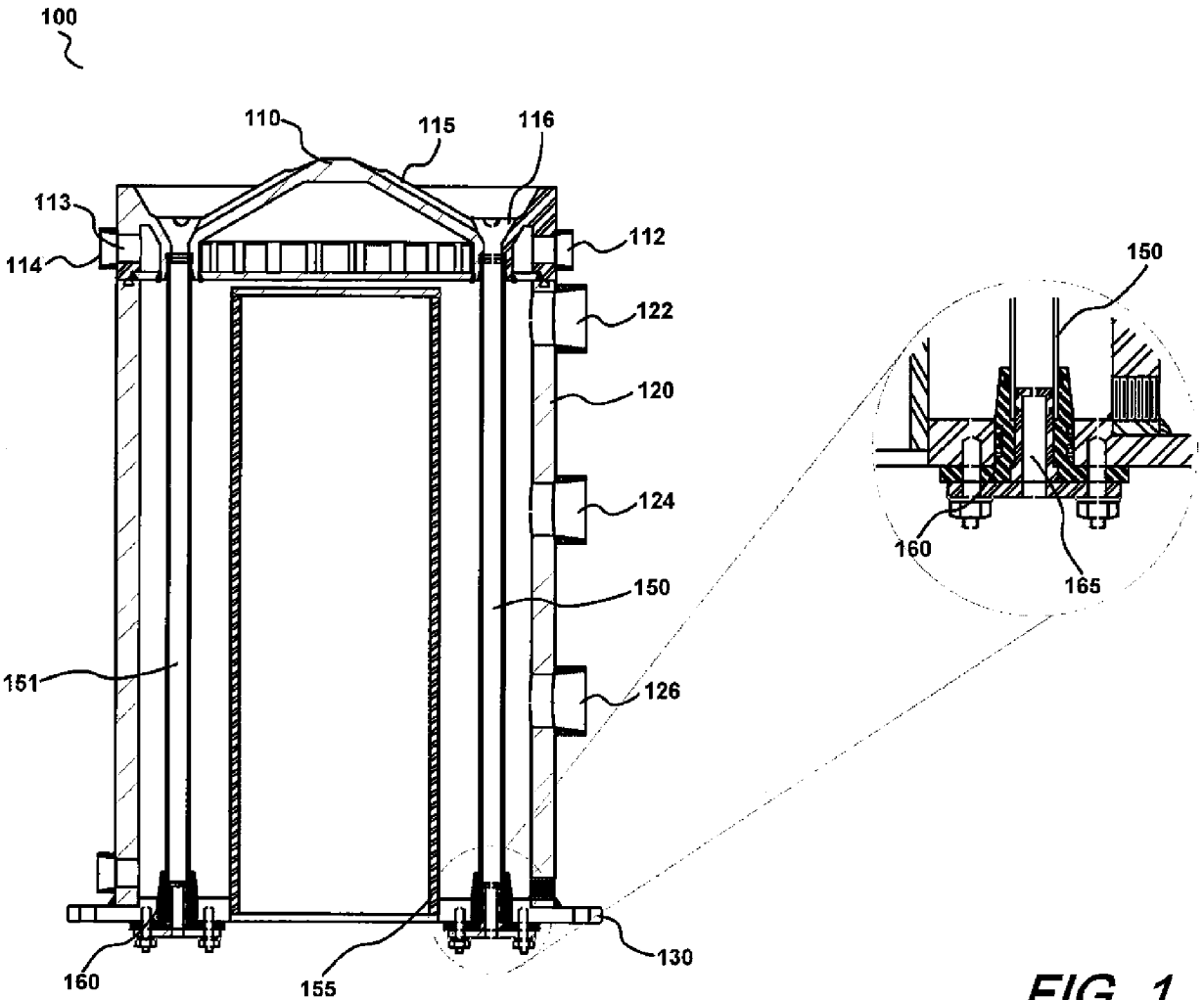
FIG. 1 is a schematic diagram showing a side cutaway view of a burster tube loading assembly and detail view of weep hole according to an aspect of the present disclosure.

With reference now to FIG. 1, there is shown a schematic cutaway diagram of an exemplary burster tube loading assembly 100 according to an aspect of the present disclosure. As shown a burster tube loading assembly 100 according to the present disclosure generally includes a distribution fixture 110 positioned upon a cooling vessel 120 which in turn is situated upon base 130. A number of burster tubes 150 are shown positioned between—and in fluid communication with—the distribution fixture 110 and receiving fixtures 160 positioned upon and generally secured to the base 130.

As those skilled in the art will readily appreciate and understand, burster tubes 150 such as those shown in FIG. 1, are tubular structures which contain an energetic material (i.e., pyrotechnic or explosive) 151. Such burster tubes are generally positioned within a projectile (not shown) and may—for example—produce smoke or other desired pyrotechnic or explosive effect upon detonation/impact of the projectile.

While not specifically shown in the figure—and in no way limiting to the present disclosure—the energetic mixture may comprise the known composition B-5 which comprises 63% RDX, 34% TNT, 1% Glyceride, and 2% liquid urethane. As may be appreciated by those skilled in the art, completely filling the burster tube 150 with a mixture 151 such as B-5 is extremely difficult since a suspension is formed and this suspension tends to separate during loading into the tube 150. Additionally, since such energetic mixtures are polymeric, they cure/solidify and therefore it is necessary that the rate/amount of solidification be controlled such that burster tubes exhibiting desirable fill characteristics are produced. Particularly problematic with prior art methods is the entrapment of air within the solidified energetic mix 151.

As those skilled in the art will further appreciate, structures and methods according to the present disclosure permit the filling of burster tubes (for example, the ones shown in FIG. 1) with most any liquefied mixture whose compositional characteristics are to be preserved during and after loading.

With continued reference to FIG. 1, it may be understood that when a number of burster tubes 150 are positioned within the burster tube loading assembly 100 and a liquid energetic mix is poured or otherwise continuously deposited upon the top of the distribution fixture 110, the energetic mix will be continuously and simultaneously distributed via distribution channels 115 formed within/upon the distribution fixture 110 through funnel-shaped conduits 116 and into the burster tubes 150. In a preferred embodiment, a displacement cylinder 155 may be positioned within the cooling cylinder 120 such that a lesser amount of coolant may be employed.

Shown further in that FIG. 1 is a detailed view of the receiving fixtures 160 which are fixed to the bottom 130 of the loading assembly 100 and which receive an end of the burster tube 150. As shown in this detailed view, the burster tube 150 is inserted into the receiving fixture 160. In a preferred embodiment, the receiving fixture 160 may be fabricated from Teflon or other suitable material.

When burster tubes are positioned in the loading assembly, the bottoms fit snugly over portions of the receiving fixtures 160. Each fixture has a weep hole 165 that allows any air trapped by the inflowing energetic mix to escape before the energetic mix solidifies. As may be readily understood, this helps to prevent large cavities from forming at the base of the filled burster tubes.

Shown further in FIG. 1 are number ports 122, 124, and 126 through the side of the cooling vessel 120 through which are circulated a coolant. Upon filling the burster tubes, cooling cycle(s) may be initiated such that the solidification of the energetic mix is controlled. As shown in this FIG. 1, the three ports allow the circulation of coolant (i.e., water) at each of three levels corresponding to the height of the port on the side of the cooling vessel 120. In this manner, the cooling of the loaded burster tubes may be selectively applied to selected portions of the burster tubes.

At this point those skilled in the art will understand that while we have used the term "coolant" to describe the material and processes employed during and after loading, our disclosure is not so limited to cooling. For example, particular energetic mixtures may require or benefit from the pre-heating of the burster tube before/during filling. In such circumstances, the "coolant" may be heated and circulated within the cooling vessel 120 thereby pre-heating the burster tubes 150 prior to their loading. Such an operation may advantageously promote the liquidity of the energetic mix and enhance its flow into the tubes.

Continuing with this discussion of pre-heating, it is noted that the distribution fixture 110 preferably includes a chamber (s) 113 through which heated coolant may be circulated via ports 112, 114. In this manner, the distribution fixture 110 may likewise be pre-heated through the effect of the circulation of heated coolant through the chamber such that the energetic mix maintains sufficient liquidity to be distributed to the burster tubes via the distribution channels 115.

Figure 2:
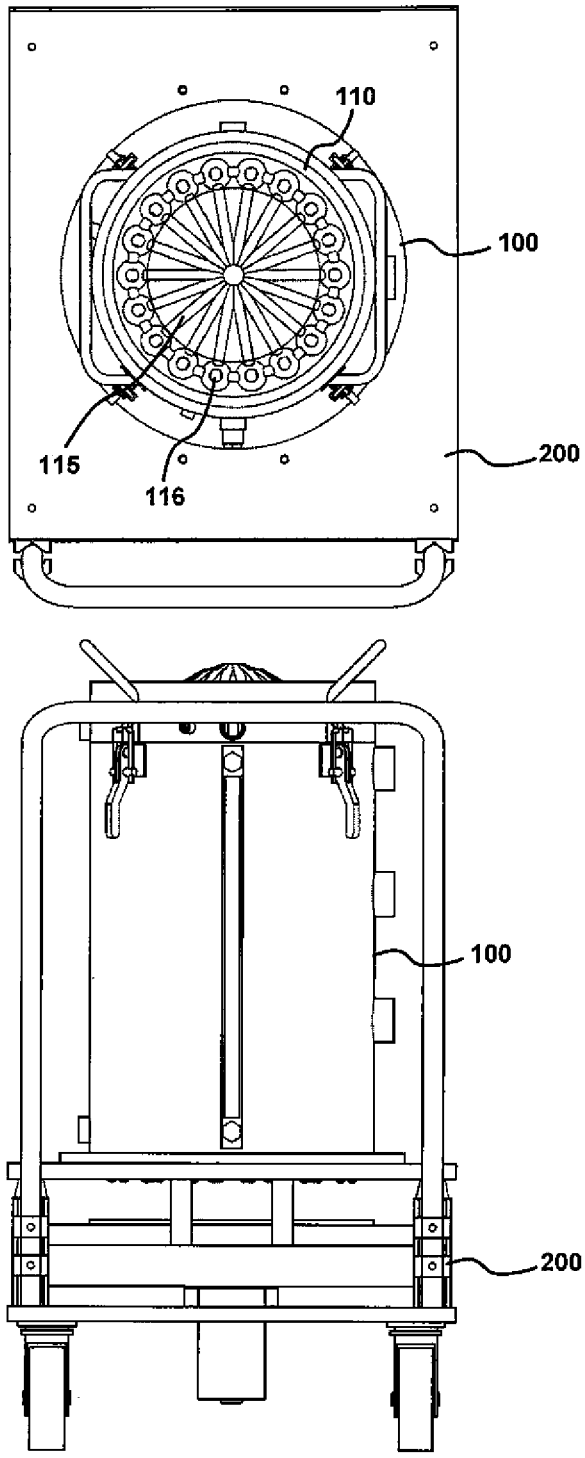
FIG. 2 is a schematic diagram showing top and rear views of the burster tube loading assembly situated on a cart according to an aspect of the present disclosure.

Turning now to FIG. 2 is a schematic diagram showing top and rear views of the burster tube loading assembly 100 situated on a cart 200 according to an aspect of the present disclosure. Of particular interest in this FIG. 2, is the top view showing the loading assembly 100, with distribution fixture situated thereupon 110 showing the distribution channels 115 and distribution funnel conduits 116. As may be readily understood from examination of this FIG. 2, when a liquid energetic material is poured into substantially the center of the distribution fixture 110, it flows down and outward via distribution channels 115 into distribution conduits 116. Not explicitly shown in this FIG. 2, is the fact that the burster tubes are positioned directly below and preferably engaged with the distribution conduits 116 such that the liquid energetic material flows into the burster tubes without any consequential leaking.

Figure 3:
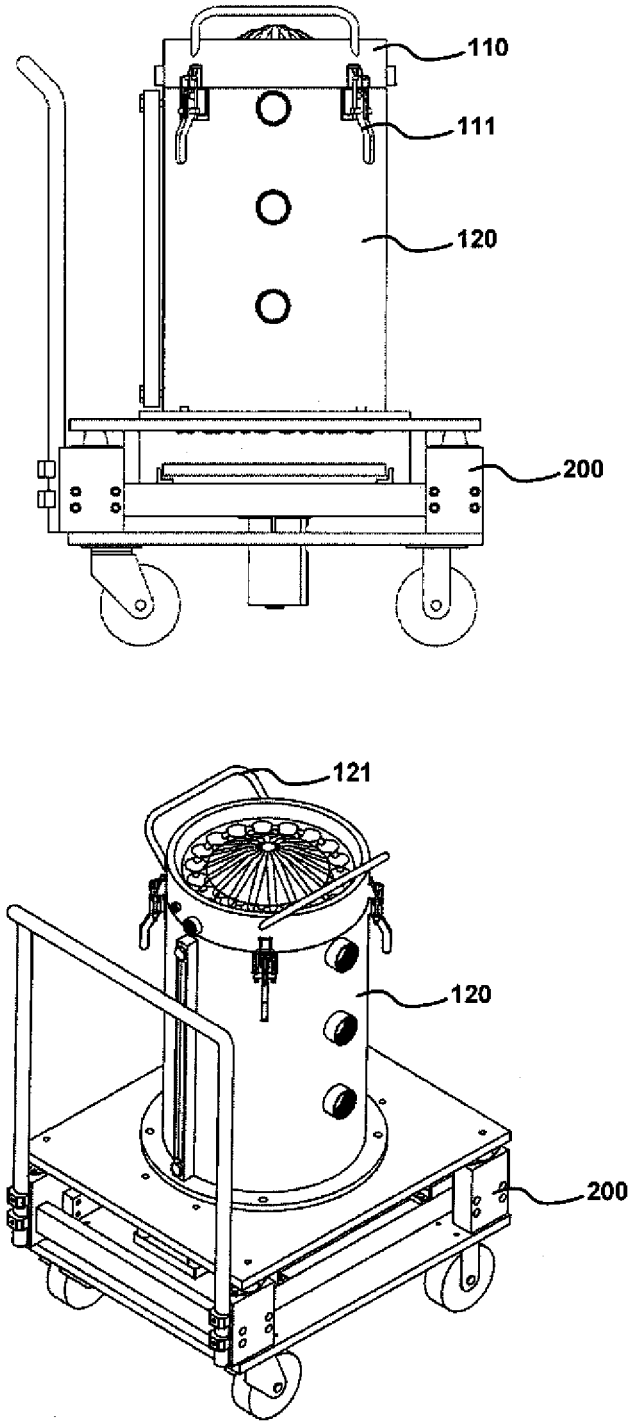
FIG. 3 is a schematic diagram showing side and perspective views of the burster tube loading assembly situated on a cart according to an aspect of the present disclosure.

FIG. 3 is a schematic diagram showing side and perspective views of the burster tube loading assembly 100 situated on a cart 200 according to an aspect of the present disclosure. Shown in this FIG. 3 are variations to the assembly including latches 111 which may advantageously secure the distribution fixture 110 to the cooling vessel 120. Shown further in this FIG. 3 are handles 121, attached to the distribution fixture 110 to permit its easy removal/replacement when loading/unloading burster into/from the assembly.

Figure 4:
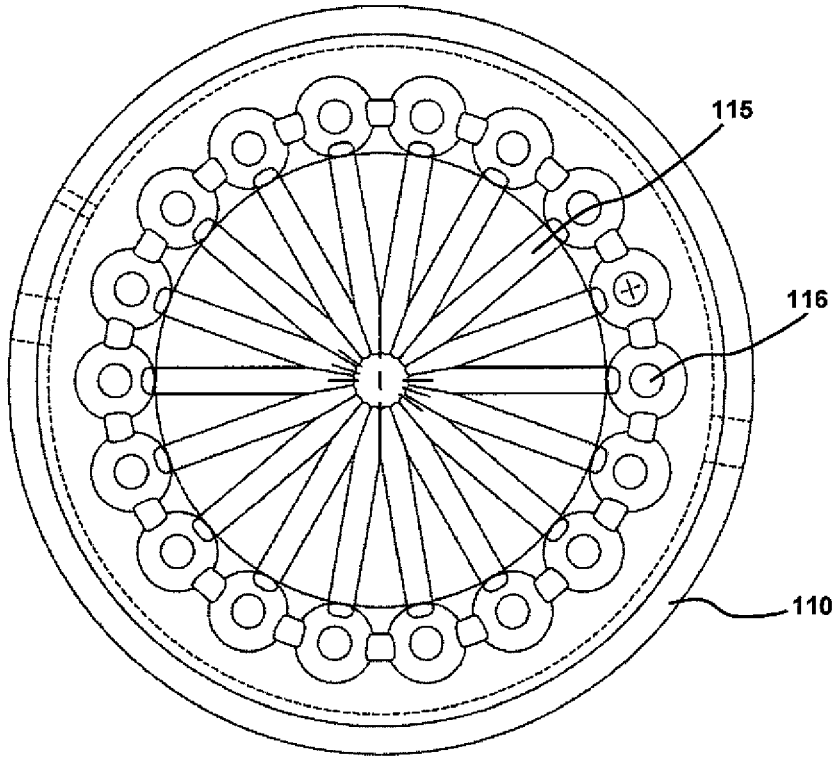
FIG. 4 is a schematic diagram showing top and side cutaway views of a distribution fixture for the burster tube loading assembly according to an aspect of the present disclosure.
Figure 4:
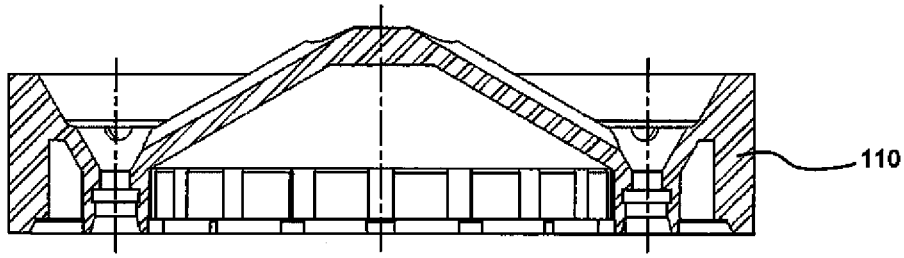

FIG. 4 is a schematic diagram showing top and side cutaway views of a distribution fixture 110 for the burster tube loading assembly 100 according to an aspect of the present disclosure. Shown in this FIG. 4 are the distribution channels 115 and distribution conduits 116 via and through which liquid energetic mixture flows into burster tubes.

Figure 5:
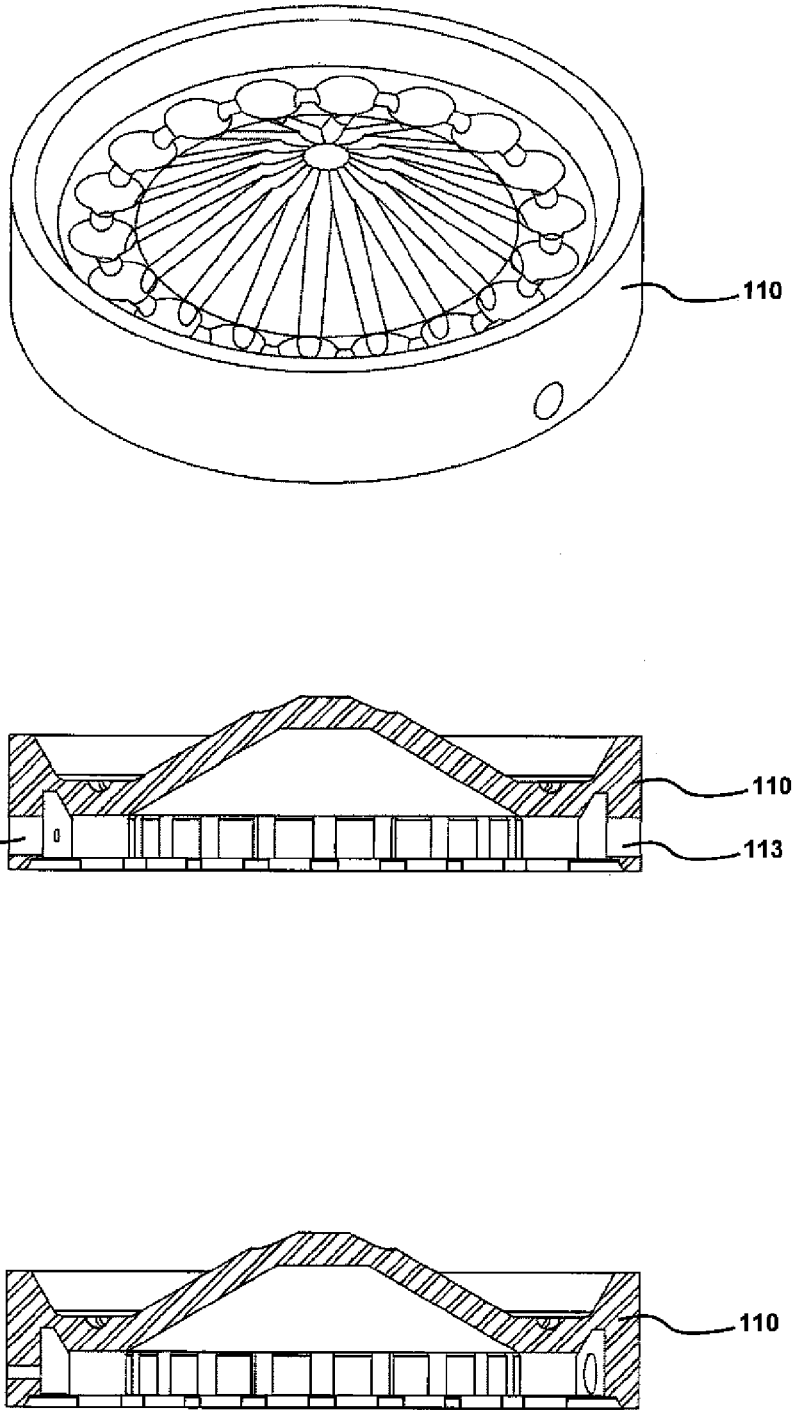
FIG. 5 is a schematic diagram showing perspective and side cutaway views of the distribution fixture for the burster tube loading assembly according to an aspect of the present disclosure.

FIG. 5 is a schematic diagram showing perspective and side cutaway views of the distribution fixture 110 for the burster tube loading assembly 100 according to an aspect of the present disclosure. Shown in this FIG. 5 are the chamber (s) 113 through which coolant may be circulated to either cool, or to pre-heat the distribution fixture 110 prior to loading the burster tubes with energetic mix.

Figure 6:
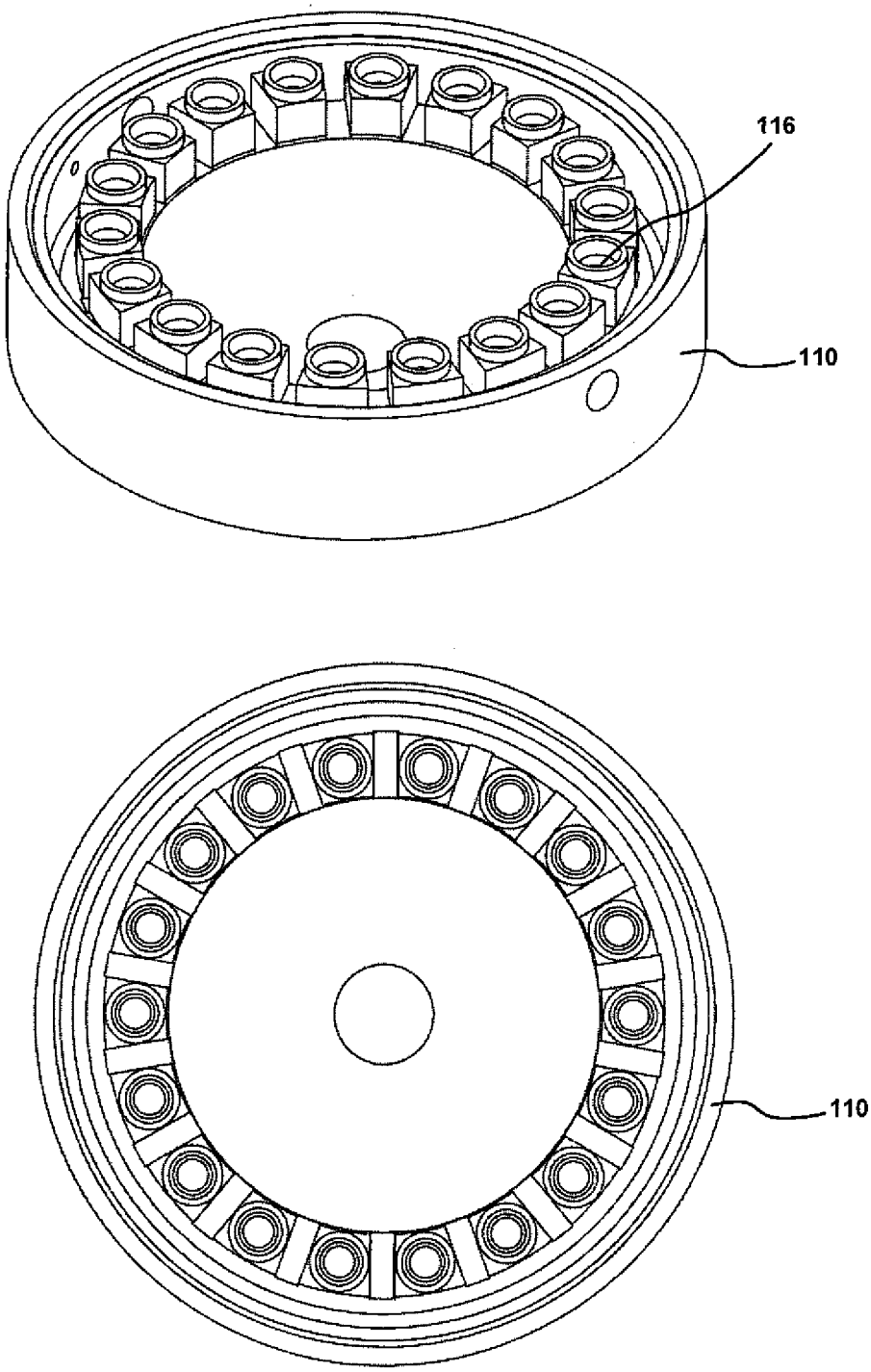
FIG. 6 is a schematic diagram showing bottom perspective and bottom views of the distribution fixture for the burster tube loading assembly according to an aspect of the present disclosure.

FIG. 6 is a schematic diagram showing bottom perspective and bottom views of the distribution fixture 110 for the burster tube loading assembly 100 according to an aspect of the present disclosure. As shown in the perspective view, the bottom of the distribution conduits may advantageously engage the burster tubes and are sized and optionally sealed such that leaking is minimized during loading of the burster tubes with energetic mix.

Figure 7:
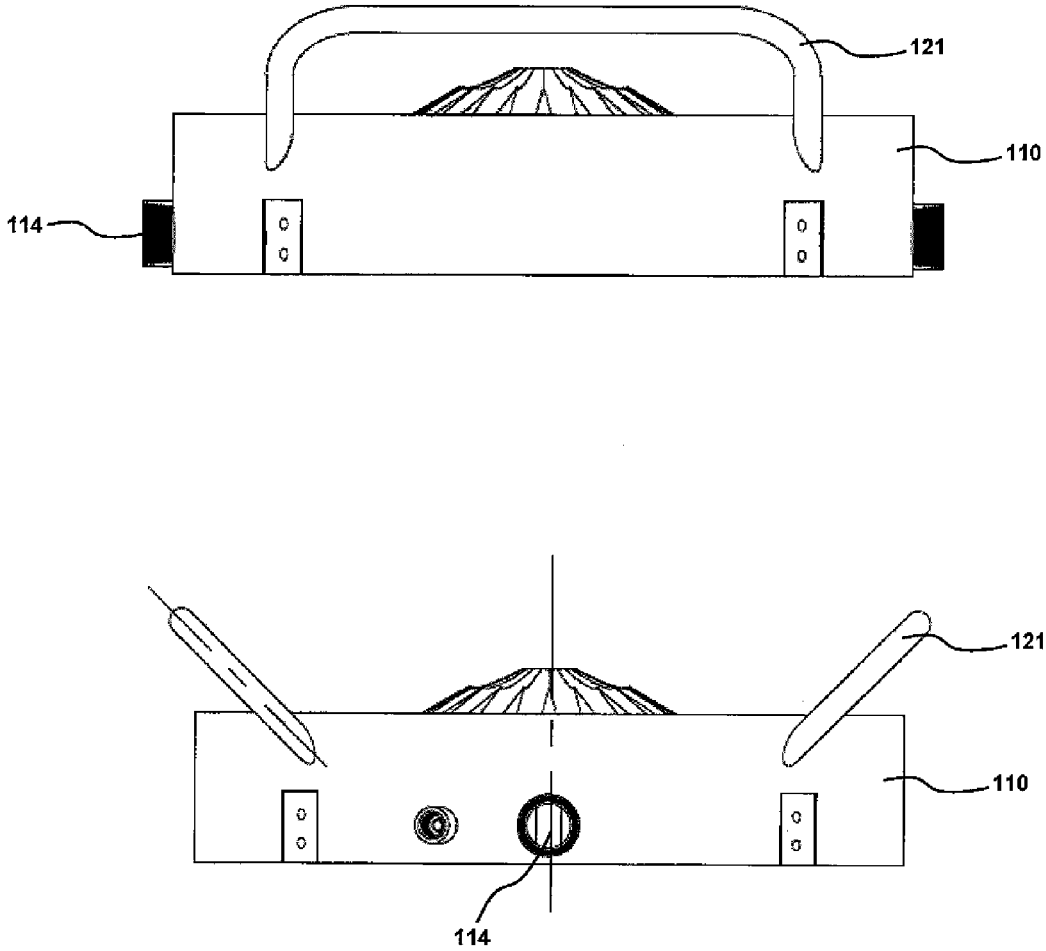
FIG. 7 is a schematic diagram showing side views of the distribution fixture for the burster tube loading assembly with handles according to an aspect of the present disclosure.

FIG. 7 is a schematic diagram showing side views of the distribution fixture 110 for the burster tube loading assembly with handles 121 according to an aspect of the present disclosure. Shown further in this FIG. 7 are ports 114 in communication with chamber(s) (not specifically shown) through which coolant may be circulated thereby heating or cooling the distribution fixture 110 as desired during loading of burster tubes.

Figure 8:
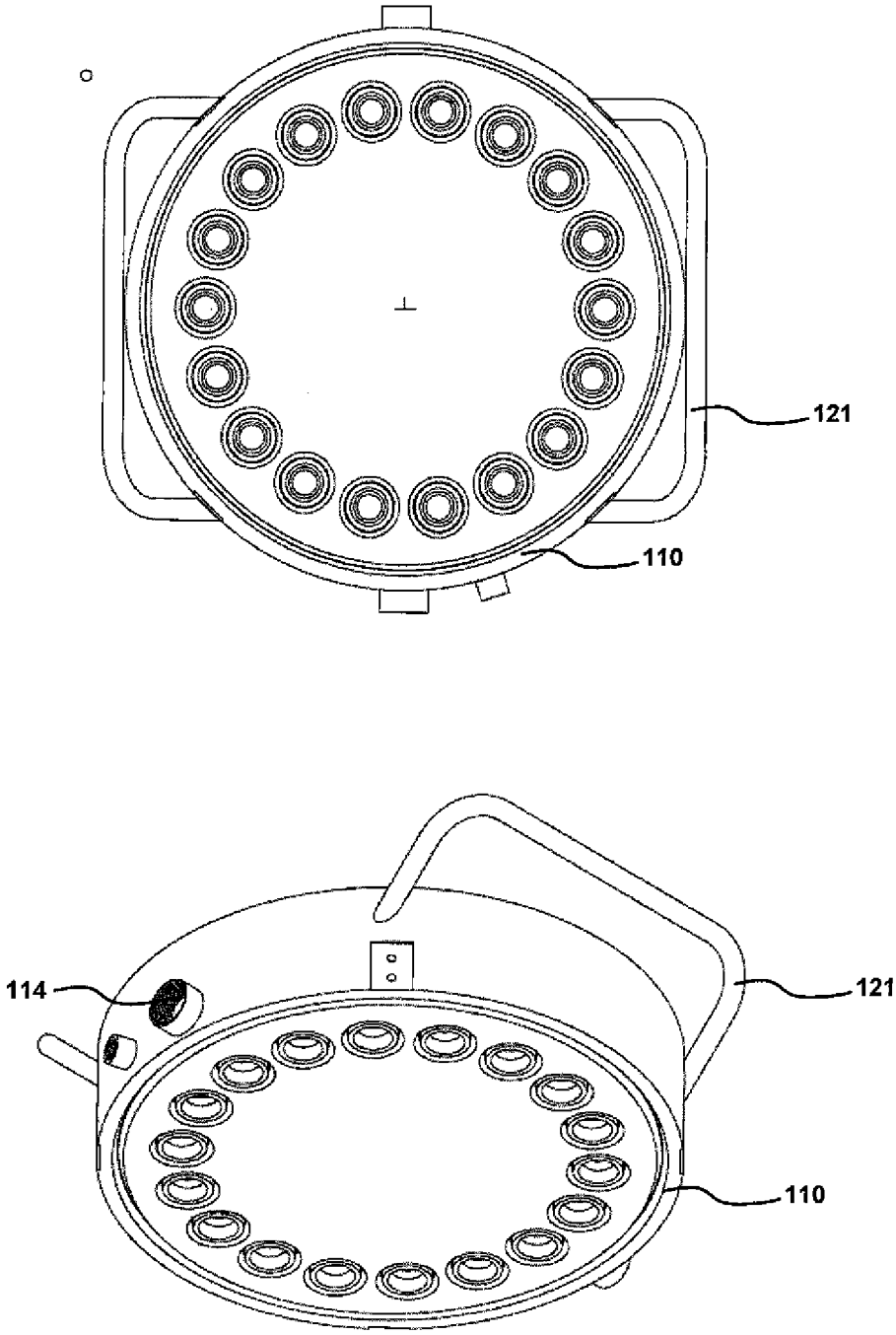
FIG. 8 is a schematic diagram showing bottom and bottom perspective views of the distribution fixture for the burster tube loading assembly with handles according to an aspect of the present disclosure.

FIG. 8 is a schematic diagram showing bottom and bottom perspective views of the distribution fixture 110 for the burster tube loading assembly with handles 121 according to an aspect of the present disclosure. Shown further is port 114 into/from which coolant moves to heat and/or cool the distribution fixture.

Figure 9:
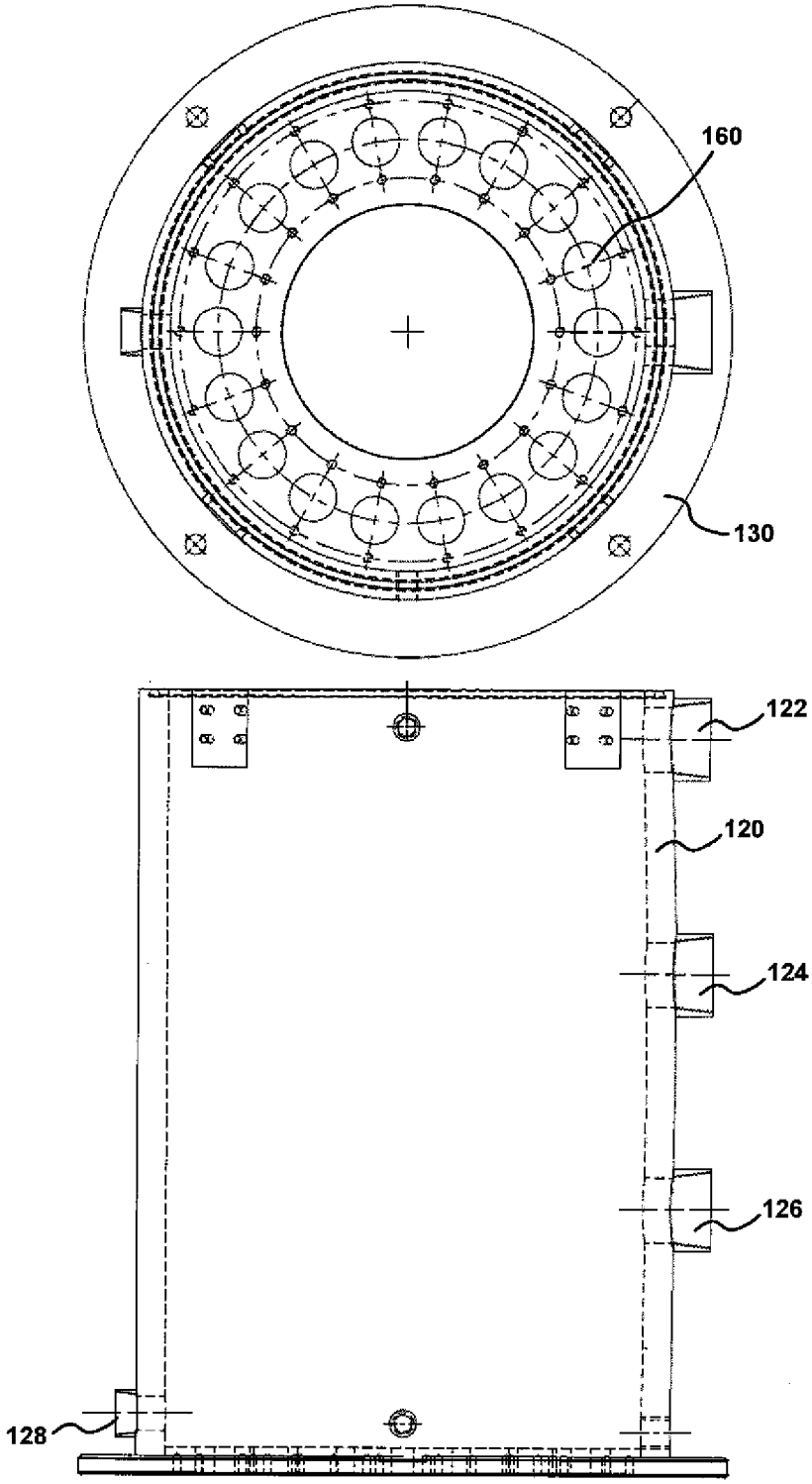
FIG. 9 is a schematic diagram showing top and side views of a cooling chamber for the burster tube loading assembly according to an aspect of the present disclosure.

FIG. 9 is a schematic diagram showing top and side views of a cooling chamber 120 for the burster tube loading assembly according to an aspect of the present disclosure. As shown in FIG. 9, the top view provides a view into the bottom portion of the cooling chamber which is situated upon the base 130. Shown further in this FIG. 9 are the plurality of receiving fixtures 160 which in a preferred embodiment are distributed radially about the center of the base and in alignment with complementary distribution conduit(s) of the distribution fixture (not specifically shown in FIG. 9). Also shown in this FIG. 9 are the arrangement of the ports 122, 124, 126 and drain port 128 which are used to circulate coolant within the cooling chamber 120 before/during/after the loading of the burster tubes.

Figure 10:
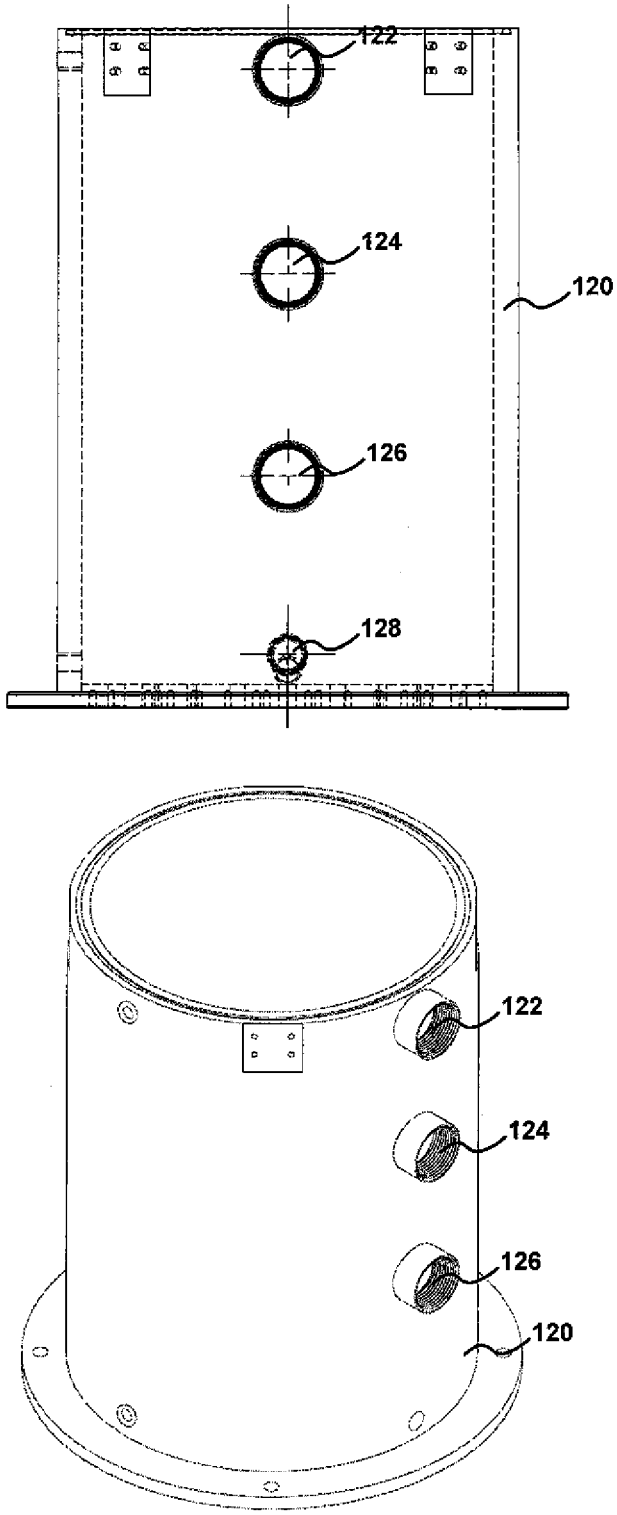
FIG. 10 is a schematic diagram showing side (front) and perspective views of the cooling chamber for the burster tube loading assembly according to an aspect of the present disclosure.

FIG. 10 is a schematic diagram showing side (front) and perspective views of the cooling chamber 120 for the burster tube loading assembly 100 according to an aspect of the present disclosure. Shown in this FIG. 10 are the plurality of ports 122, 124, 126, and 128 which may be used to fill/circulate/drain coolant within the cooling chamber. As may be appreciated by those skilled in the art, the ports are positioned such that a desirable coolant level may be achieved/maintained to provide the desired amount of cooling to the burster tubes as desired. In addition, and as previously noted, while we have used the term "coolant" throughout this specification, such coolant may be used to heat the burster tubes as desired and as appropriate.

At this point, while we have discussed and described the burster tube loading assembly it is noted that the assembly may be fabricated from a single or a number of materials as appropriate. For example, in a preferred embodiment stainless steel(s) and/or aluminum may be employed depending upon the materials and temperatures employed while filling the burster tubes. The receiving fixtures may be fabricated from Teflon or other materials which provide suitable chemical properties.

Operationally, burster tubes are positioned into a respective receiving fixture positioned at the bottom of the cooling chamber. As described previously and shown in the drawing, an individual burster tube is inserted into the receiving fixture and sufficiently sealed such that when the liquefied energetic mix is flowed into the tube, no undesirable leakage occurs. As may be appreciated, when a particularly tight seal is required o-rings or other known sealing structures may be employed within the retaining fixture(s) as necessary. As shown in the figures, a preferred embodiment of the positioning of the receiving fixtures is that they are radially positioned along the bottom of the cooling chamber.

Once the burster tubes are so positioned, the distribution fixtures is secured to the top of the cooling chamber. The distribution fixture includes a number of distribution conduits and these conduits are aligned with and engage the top portion of the burster tubes. In the exemplary embodiments shown and described, there are 18 distribution conduits formed in the distribution fixture although those skilled in the art will appreciate that a greater or lesser number of conduits may be fabricated as desired and/or required.

Accordingly, a liquefied mix—for example B-5 described previously, is poured or otherwise applied to the top of the distribution fixture where it is distributed via distribution channels to the distribution conduits and into the burster tubes. As noted previously, a pre-heated coolant may be circulated through an inner chamber of the distribution fixture such that it maintains a temperature suitable to maintain a desirable liquid characteristic of the energetic mix.

As the liquid energetic mix flows down into the burster tubes, trapped air is vented through the weep holes such that a uniform mix is loaded into the tubes. As the tubes fill with energetic mix, a coolant may be circulated through the cooling cylinder. By selectively controlling the coolant level through the use of the ports on the side of the cooling cylinder, the height of the cooling liquid (preferably water) may be controlled such that portions of the burster tubes are filled and cooled prior to later (higher) portions. In this manner, a uniform energetic mix is controllably filled and solidified in the burster tubes thereby ensuring uniformity in performance.

The invention claimed is:

1. A method for loading burster tubes with an energetic mix comprising the steps of:

simultaneously and continuously flowing a quantity of liquid energetic mixture into a plurality of burster tubes;

venting air trapped in the burster tubes via receiving fixtures into which each one of the plurality of burster tubes are inserted; and selectively cooling portions of the burster tubes.

2. The method of claim 1 further comprising the step of pouring a quantity of the liquid energetic mixture onto a distribution fixture such that the liquid energetic mixture simultaneously and continuously flows into the plurality of burster tubes via a plurality of distribution conduits.

3. The method of claim 1 further comprising the step of pre-heating the distribution fixture.

4. The method of claim 3 wherein the pre-heating of the distribution fixture comprises the step of circulating a quantity of heated coolant in a cavity formed within the distribution fixture.

5. The method of claim 1 wherein said selective cooling comprises the step of circulating a quantity of coolant in a cooling cylinder positioned between the distribution fixture and the receiving fixtures such that the coolant contacts each of the burster tubes up to a desired level.

6. The method of claim 5 further comprising the step of raising the level of coolant in the cooling cylinder up to a further desired level.

7. The method of claim 1 wherein said energetic mix is the energetic composition B-5.

8. The method of claim 1 wherein the energetic mix is a polymeric suspension.

9. An apparatus for loading burster tubes comprising:

a cooling cylinder;

a distribution fixture situated upon the cooling cylinder for simultaneously and continuously loading a plurality of the burster tubes with an energetic mix; and a base, onto which is positioned the cooling cylinder, said base including a plurality of receiving fixtures each for receiving an end of one of the plurality of burster tubes.

10. The apparatus according to claim 9 wherein the cooling cylinder includes a number of ports, each positioned at a different height of the cylinder, for effecting/maintaining a quantity of coolant in the cylinder at a desired level.

11. The apparatus of claim 9 wherein the distribution fixture includes a plurality of distribution conduits, one for each of the burster tubes, through which the energetic mix flows into the burster tubes.

12. The apparatus of claim 11 wherein said distribution fixture includes a plurality of distribution channels for providing fluid communication between each of the distribution conduits and a center portion of the distribution fixture such that a liquid, poured in the center portion of the distribution fixture will simultaneously and uniformly flow to the distribution conduits via the distribution channels.

13. The apparatus of claim 12 wherein said uniform flow of the liquid is a uniform volumetric flow.

14. The apparatus of claim 9 wherein each of the receiving fixtures includes a weep hole for venting air from the bottom of the burster tube as it is loaded.

15. The apparatus of claim 9 wherein said distribution fixture includes a chamber through which coolant flows such that the distribution fixture may be heated/cooled through the effect of the coolant flow.

* * * * *